US009329521B2

(12) United States Patent
Sakato

(10) Patent No.: US 9,329,521 B2
(45) Date of Patent: May 3, 2016

(54) BIAS CONTROL AND IMAGE FORMING APPARATUS COMPRISING THE SAME

(71) Applicant: KYOCERA Document Solutions Inc., Osaka (JP)

(72) Inventor: Shingo Sakato, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/480,917

(22) Filed: Sep. 9, 2014

(65) Prior Publication Data

US 2015/0104207 A1 Apr. 16, 2015

(30) Foreign Application Priority Data

Oct. 10, 2013 (JP) ..... 2013-212582
Jul. 4, 2014 (JP) ..... 2014-138247

(51) Int. Cl.
*G03G 15/06* (2006.01)
*G03G 15/02* (2006.01)

(52) U.S. Cl.
CPC ..... *G03G 15/065* (2013.01); *G03G 15/0266* (2013.01); *G03G 15/0283* (2013.01)

(58) Field of Classification Search
CPC ..... G03G 15/0266; G03G 15/065; G03G 15/0283
See application file for complete search history.

(56) References Cited

U.S. PATENT DOCUMENTS

2010/0239287 A1* 9/2010 Shibuya ..... G03G 15/0266 399/50
2014/0147139 A1* 5/2014 Hasegawa ..... G03G 15/0266 399/50

FOREIGN PATENT DOCUMENTS

JP H09-106142 A 4/1997

* cited by examiner

*Primary Examiner* — Rodney Bonnette
(74) *Attorney, Agent, or Firm* — Studebaker & Brackett PC

(57) ABSTRACT

An image forming apparatus includes a charging member, a charging bias power source, a developing member, a developing bias power source and a controlling device. The charging member electrically charged an image carrier. The charging bias power source applies a DC charging bias to the charging member. The developing member develops a toner image onto the image carrier. The developing bias power source applies an AC and DC developing bias to the developing member. The controlling device carries out, before image forming process, pre-charging control controlling the charging bias power source to electrically charge the image carrier. The controlling device carries out, after the image forming process is started, post-charging control controlling the charging bias power source and developing bias power source to adjust an electrical potential difference between a surface potential of the image carrier and developing bias to a significant electrical potential difference preventing occurrence of image failure.

10 Claims, 6 Drawing Sheets

BIAS CONTROL AND IMAGE FORMING APPARATUS COMPRISING THE SAME

INCORPORATION BY REFERENCE

This application is based on and claims the benefit of priority from Japanese Patent application No. 2013-212582 filed on Oct. 10, 2013, and Japanese Patent application No. 2014-138247 filed on Jul. 4, 2014, the entire contents of which are incorporated herein by reference.

BACKGROUND

The present disclosure relates to an image forming apparatus preferably applied in a copying machine, a printer or the like.

An image forming apparatus according to an electrophotographic technique carries out image forming process in procedures of developing an electrostatic latent image formed on a surface of a photosensitive drum by a toner, and transferring and fixing the developed toner image onto a recording medium.

Recently, as a manner electrically charging the photosensitive drum in such an image forming apparatus, for example, a contact charging manner arranging a roller type charger to come into contact with or to come into close contact with the photosensitive drum so as to electrically charge the photosensitive drum is widely applied. In general, in the surface of the photosensitive drum, an organic photoconductor (OPC) is applied and, in the charger, a conductive rubber roller is applied.

For example, there is an image forming apparatus including a contact type charger, a voltage applying means for the charger, a developing device, a transferring/separating device and a surface potential detecting means. The contact type charger electrically charges the surface of the photosensitive drum. The developing device develops the electrostatic latent image formed by an exposure device (an optical system) to the toner image. The transferring/separating device transfers the toner image onto a sheet. The surface potential detecting means measures a surface potential of the photosensitive drum. This image forming apparatus measures the surface potential of the photosensitive drum by surface potential detecting means and carries out feedback control of an applied voltage to the charger.

Incidentally, it is known that it is difficult to electrically charge the surface of the photosensitive drum composed of the OPC to a rated electrical potential in a short time by the contact charging type charger. The above-mentioned image forming apparatus generally carries out application of a charging bias (pre-charging process) in advance of a start of the actual image forming process. In the above-mentioned image forming apparatus, in order to shorten a time from a print instruction of a user to print completion (a first print time), in general, when the surface potential of the photosensitive drum is electrically charged to an electrical potential enabling the image forming by the pre-charging process, even if the surface potential of the photosensitive drum has not reached an objective surface potential, the image forming process is started with respect to a first sheet.

In a situation where the photosensitive drum has not reached the objective surface potential, in a case of starting the image forming process, an electrical potential difference between the surface potential and a developing bias in that time is smaller than a rated electrical potential difference. In this case, a phenomenon making the toner adhere to a white area on which the image is not formed onto the first sheet in a printing job, so called fogging, occurs.

SUMMARY

In accordance with an embodiment of the present disclosure, an image forming apparatus includes a charging member, a charging bias power source, a developing member, a developing bias power source and a controlling device. The charging member is arranged to come into contact with or to come into close contact with a surface of an image carrier so as to electrically charge the surface of the image carrier. The charging bias power source applies a charging bias as a direct current voltage to the charging member. The developing member is arranged to face to the surface of the image carrier so as to develop a toner image onto the surface of the image carrier. The developing bias power source applies a developing bias taken by superposing alternating current voltage and direct current voltage to the developing member. The controlling device controls the charging bias power source and developing bias power source. The controlling device carries out pre-charging control, before starting image forming process transferring the toner image developed on the surface of the image carrier to a transferred medium, to control the charging bias power source so as to electrically charge the surface of the image carrier. The controlling device carries out post-charging control, after the image forming process is started, to control the charging bias power source and developing bias power source so as to adjust an electrical potential difference between a surface potential of the image carrier and developing bias to a significant electrical potential difference preventing occurrence of image failure.

In accordance with an embodiment of the present disclosure, an image forming apparatus includes a charging member, a charging bias power source, a developing member, a developing bias power source and a controlling device. The charging member is arranged to come into contact with or to come into close contact with a surface of an image carrier so as to electrically charge the surface of the image carrier. The charging bias power source applies a charging bias as a direct current voltage to the charging member. The developing member is arranged to face to the surface of the image carrier so as to develop a toner image onto the surface of the image carrier. The developing bias power source applies a developing bias taken by superposing alternating current voltage and direct current voltage to the developing member. The controlling device controls the charging bias power source and developing bias power source. The controlling device carries out pre-charging control, before starting image forming process transferring the toner image developed on the surface of the image carrier to a transferred medium, to control the charging bias power source so as to electrically charge the surface of the image carrier. The controlling device carries out post-charging control, after the image forming process is started, to control the charging bias power source so as to apply a first charging bias as a rated charging bias and to control the developing bias power source so as to apply a third developing bias having a higher frequency than a frequency of alternating current voltage of a first developing bias as a rated developing bias.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

In the following, embodiments of the present disclosure will be described with reference to the appended drawings.

Figure 1:
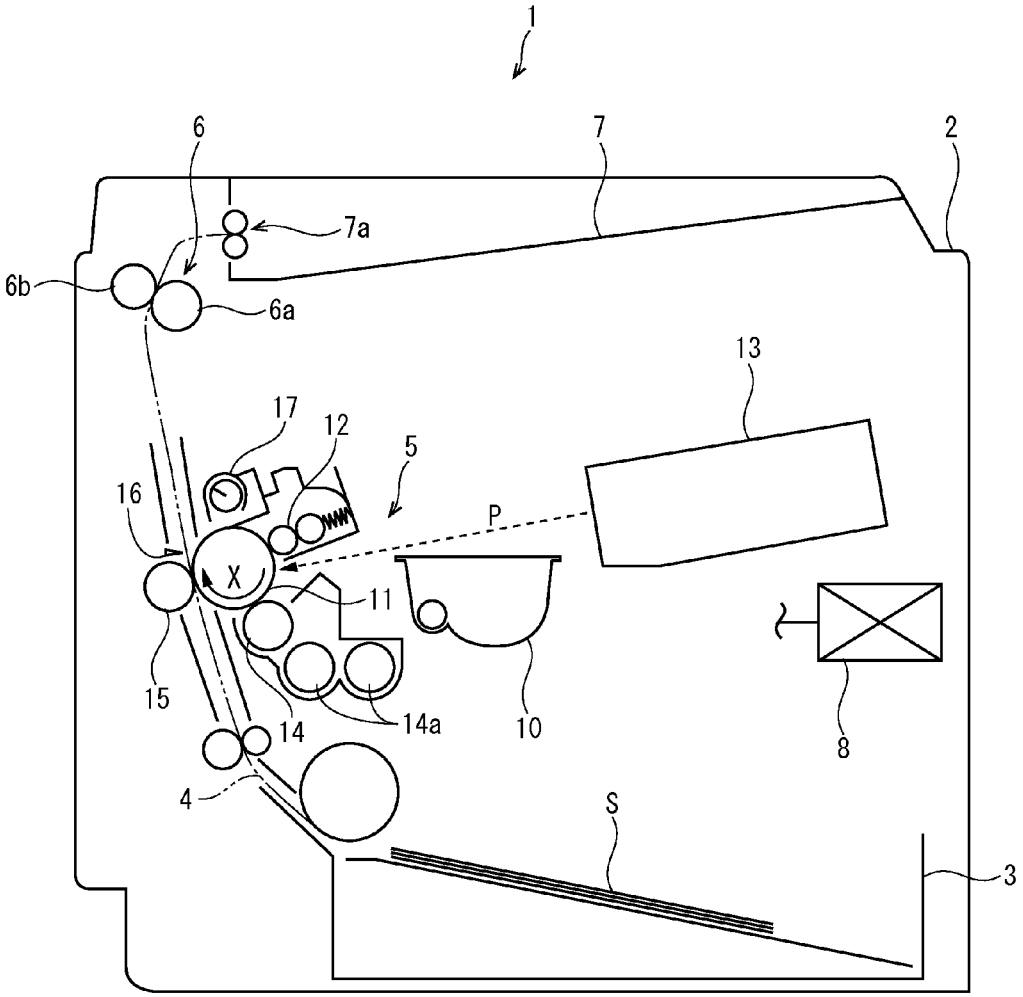
FIG. 1 is a sectional view schematically showing an inner structure of an image forming apparatus in accordance with a first embodiment of the present disclosure.
Figure 2:
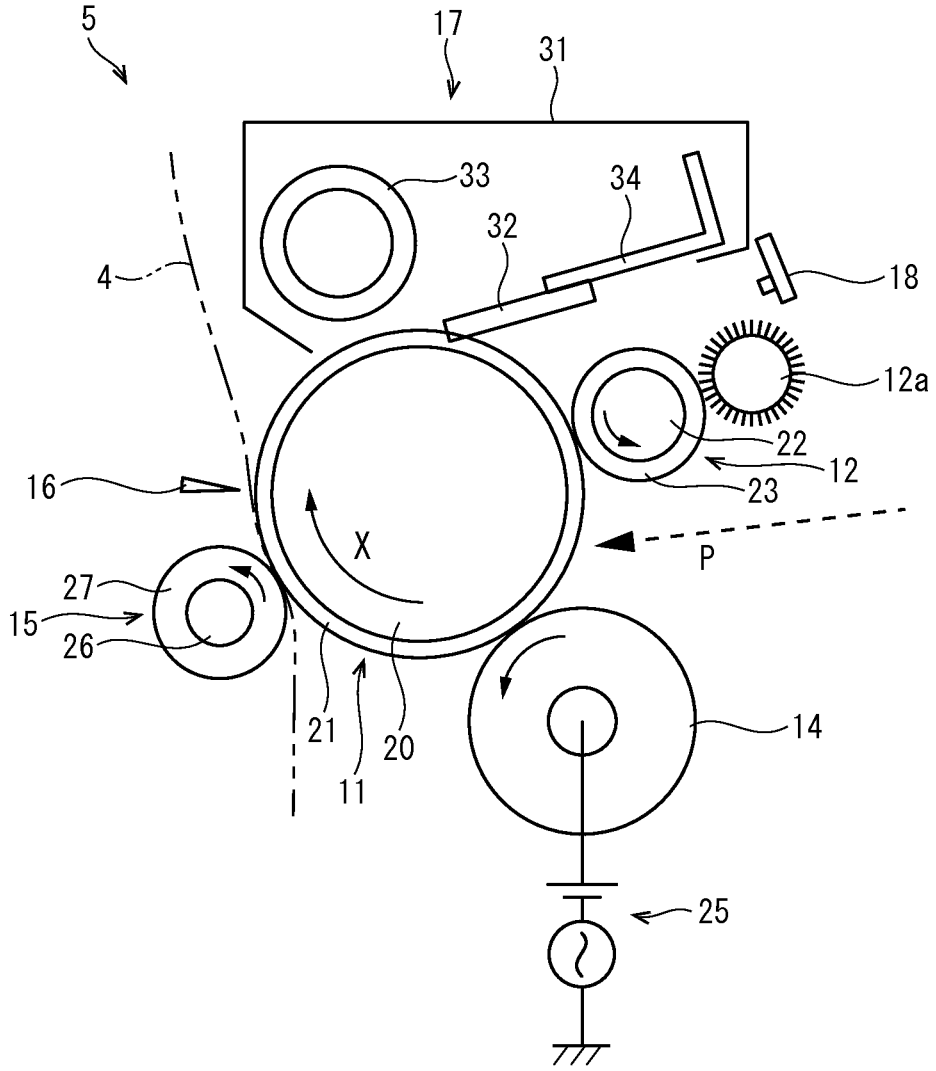
FIG. 2 is a side view schematically showing an image forming part of the image forming apparatus in accordance with the first embodiment of the present disclosure.
Figure 3:
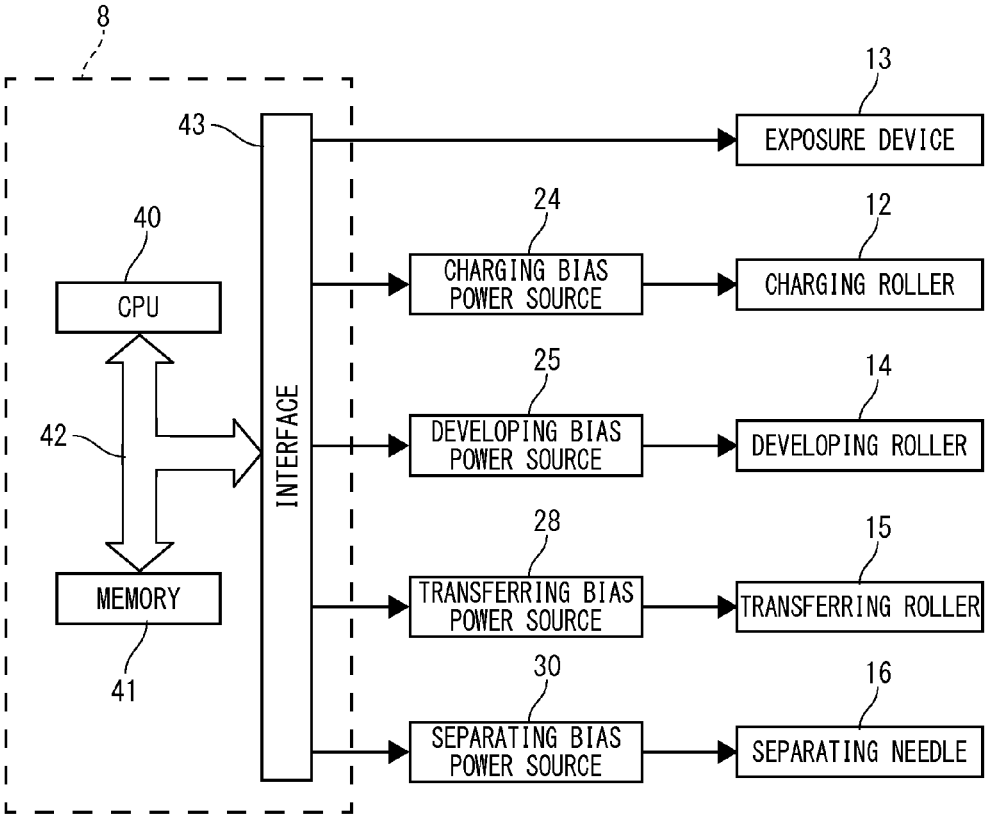
FIG. 3 is a block diagram showing a controlling device and other components in the image forming apparatus in accordance with the first embodiment of the present disclosure.

With reference to FIGS. 1 to 3, an image forming apparatus 1 in accordance with a first embodiment will be described. FIG. 1 is a sectional view schematically showing an inner structure of the image forming apparatus 1. FIG. 2 is a side view schematically showing an image forming part 5 of the image forming apparatus 1. FIG. 3 is a block diagram showing a controlling device 8 and other components in the image forming apparatus 1.

As shown in FIG. 1, the image forming apparatus 1 includes a sheet storing part 3, the image forming part 5, a fixing device 6, a sheet ejecting part 7 and the controlling device 8 inside a roughly box-like formed apparatus main body 2. The sheet storing part 3 is configured to store a sheet S. The image forming part 5 is configured to transfer a toner image onto the sheet S fed from the sheet storing part 3 to a conveying path 4. The fixing device 6 is configured to fix the transferred toner image onto the sheet S. The sheet ejecting part 7 is an ejection destination of the sheet S after the fixing. The controlling device 8 is configured to centrally control each component.

The image forming part 5 is controlled by the controlling device 8, for example, to carry out monochrome image forming process on the basis of image data transmitted from a personal computer (not shown) or the like. The image forming part 5 includes a toner container 10, a photosensitive drum 11, a charging roller 12, an exposure device 13, a developing roller 14, a transferring roller 15, a separating needle 16, a cleaning device 17 and a static eliminating device 18 (refer to FIG. 2). The toner container 10 is configured to contain a replenishment toner (a developer (black)). The charging roller 12, exposure device 13, developing roller 14, transferring roller 15, separating needle 16, cleaning device 17 and static eliminating device 18 are arranged around the photosensitive drum 11 as an image carrier in transferring process order (refer to an arrow X indicated in FIG. 1).

As shown in FIG. 2, the photosensitive drum 11 is configured to be composed of a drum tube stock 20 and a photosensitive layer 21. The drum tube stock 20 is formed in a cylindrical shape by conductive material, such as aluminum. The photosensitive layer 21 is formed to be coated on the outer circumference face of the drum tube stock 20. The photosensitive drum 11 is extended in a width direction (in a depth direction of a plane of FIG. 2) of the sheet S orthogonal to a conveying direction of the sheet S, and rotationally driven by a driving device (not shown). The photosensitive layer 21 is made of a positive charged monolayer organic photoconductor (OPC) having low injurious and excellent mass productivity. The photosensitive layer 21 has a layer thickness of a degree of 20-30 μm.

The charging roller 12 as a charging member is arranged to come into contact with the surface (the photosensitive layer 21) of the photosensitive drum 11. The charging roller 12 electrically charges the surface of the photosensitive drum 11 evenly by predetermined polarity and electrical potential (in the so-called contact charging manner). The charging roller 12 is configured to be composed of a charging shaft 22 and a charging rubber layer 23. The charging shaft 22 is made of a solid cylindrical formed conductive material. The conductive charging rubber layer 23 is formed on the outer circumference face of the charging shaft 22. The charging roller 12 is arranged in parallel to the photosensitive drum 11, and rotationally driven by a driven device (not shown). The charging rubber layer 23 is made by combining an epichlorohydrin rubber or the like, for example, with an ion conductive agent. The charging rubber layer 23 has a layer thickness of a degree of 1-3 mm.

At an opposite side to the photosensitive drum 11 across the charging roller 12, a brush roller **12*a* is arranged. The brush roller 12*a* comes into contact with the surface of the charging roller 12 and is rotated so as to remove a deposit on the surface of the charging roller 12**.

The charging roller 12 is connected to a charging bias power source 24 (refer to FIG. 3). The charging bias power source 24 applies a charging bias as direct current (DC) voltage to the charging roller 12 in order to electrically charge the photosensitive layer 21 of the photosensitive drum 11.

As shown in FIG. 1, the exposure device 13 polarizes and scans a luminous flux emitted from a light source (not shown) by a polarizer, such as a polygon mirror (not shown), and makes an image of the luminous flux to the photosensitive drum 11. Thereby, an electrostatic latent image is formed on the surface (the photosensitive layer 21) of the photosensitive drum 11.

As shown in FIG. 2, the developing roller 14 as a developing member is arranged to face to the surface of the photosensitive drum 11 at a predetermined gap. The developing roller 14 makes the toner, which is supplied from toner container 10, adhere the electrostatic latent image formed on the surface of the photosensitive drum 11. The developing roller 14 is arranged in parallel to the photosensitive drum 11, and rotationally driven by a driving device (not shown). The developing roller 14 is configured by fixing magnets (not shown) having respective different polarities inside a non-magnetic cylindrical formed sleeve. Below the developing roller 14, a pair of conveying screws **14*a* to agitate and convey the toner are arranged to face to each other (refer to FIG. 1**).

In addition, the developing roller 14 is connected to a developing bias power source 25. The developing bias power source 25 includes an alternating current (AC) power source and a direct current (DC) power source to apply a developing bias taken by superposing alternating current voltage and direct current voltage to the developing roller 14. The developing roller 14 develops the toner image onto the surface (the photosensitive layer 21) of the photosensitive drum 11 by the applied developing bias.

The transferring roller 15 is arranged to face to the surface of the photosensitive drum 11. The transferring roller 15 makes the conveyed sheet S come into pressure contact with the photosensitive drum 11 to transfer the toner image developed on the surface of photosensitive drum. 11 onto the sheet S. The transferring roller 15 is configured to include a transferring shaft 26 and a transferring rubber layer 27. The transferring shaft 26 is made of conductive material. The conductive transferring rubber layer 27 is formed on the outer circumference face of the transferring shaft 26.

In addition, the transferring roller 15 is connected to a transferring bias power source 28 (refer to FIG. 3). The transferring bias power source 28 applies a transferring bias to the transferring roller 15. Since the transferring bias has an opposite polarity to a polarity of the charged toner, the toner image on the photosensitive drum 11 is attracted to the transferring roller 15, to which the transferring bias is applied, and transferred onto the sheet S conveyed between the photosensitive drum 11 and transferring roller 15. The sheet S as a transferred medium is not restricted by a paper recording medium, but implies another recording medium, such as a plastic film or an overhead projector (OHP) sheet.

The separating needle 16 is arranged to face to the surface of the photosensitive drum 11 to separate the sheet S having the transferred toner image from the photosensitive drum 11. The separating needle 16 is formed in a roughly comb shape by conductive material, such as stainless steel. The separating needle 16 is arranged in a state where a plurality of needle like top end parts are faced to the photosensitive drum 11. Since the top end part of the separating needle 16 is formed in a needle shape, an electric discharge easily is caused from the top end part.

In addition, the separating needle 16 is connected to a separating bias power source 30 (refer to FIG. 3). The separating bias power source 30 applies a separating bias to the separating needle 16. The separating needle 16 separates the sheet S stuck onto the surface of the photosensitive drum 11 from the photosensitive drum 11 by the applied separating bias.

The cleaning device 17 removes the toner remained on the surface of the photosensitive drum 11 after the transferring. The cleaning device 17 includes a cleaning blade 32 and a discharging screw 33 inside a housing 31. The cleaning blade 32 is configured so as to come into slide contact with the surface (the photosensitive layer 21) of the photosensitive drum 11. The discharging screw 33 is configured so as to discharge the removed toner (a waste toner).

The cleaning blade 32 is, for example, made of polyurethane rubber and formed in a plate shape extending in an axis direction of the photosensitive drum 11. An upper end side of the cleaning blade 32 is fixed to a blade holder 34 formed in an L-shape. A lower end part of the cleaning blade 32 comes into contact with the outer circumference face of the photosensitive drum 11 in a counter direction. The blade holder 34 is fixed inside the housing 31. The cleaning blade 32 is pressured to the photosensitive drum 11 by a biasing part (not shown) so as to scrape and remove the deposit, such as the toner, remained on the surface of the photosensitive drum 11. The biasing part may be omitted and the cleaning blade 32 may be pressured to the photosensitive drum 11 by its own elastic force.

The discharging screw 33 is arranged at an upstream side from the cleaning blade 32 in a rotating direction of the photosensitive drum 11. To one end in an axis direction of the discharging screw 33, a waste toner collecting case (not shown) is connected. The discharging screw 33 is rotationally driven by a driving part (not shown), thereby discharging the waste toner to the waste toner collecting case.

The static eliminating device 18 irradiates the surface of the photosensitive drum 11 with a light in order to eliminate a charge remained on the photosensitive layer 21 of the photosensitive drum 11.

As shown in FIG. 1, the fixing device 6 includes a heating roller 6*a* and a pressuring roller 6*b*. The heating roller 6*a* is arranged at a side, where the toner image is transferred, in the sheet S, and configured to be rotationally driven. The pressuring roller 6*b* is arranged to face to the heating roller 6*a* and configured to be co-rotated. The toner image transferred onto the surface of the sheet S is melted by contacting the heating roller 6*a* and fixed onto the sheet S by being pressured from a back face side of the sheet S by the pressuring roller 6*b*.

As shown in FIG. 3, the controlling device 8 includes a central processing unit (CPU) 40, a memory 41, a bus 42 and an interface 43. The memory 41 is composed of a read only memory (ROM), a random access memory (RAM), a flash memory and others. The bus 42 is configured to connect the CPU 40 and memory 41. The interface 43 is connected to each component of the image forming apparatus 1.

The CPU 40 executes an operation process in accordance with each program or the like stored in the memory 41. In the memory 41, a program necessary for image forming process control and other programs to centrally control the image forming apparatus 1 are stored. Moreover, in the memory 41, an objective value of a surface potential of the photosensitive drum 11 (hereinafter, called as an "objective potential"), rated values of the charging bias, developing bias, transferring bias and separating bias, and others are stored in advance.

To the interface 43, the exposure device 13, charging bias power source 24, developing bias power source 25, transferring bias power source 28, separating bias power source 30 and others (hereinafter, called as "power sources and others") are connected. Thereby, various control signals are transmitted from the controlling device 8 to the power sources and others. That is, the controlling device 8 controls the power sources and others by making the CPU 40 execute each program or the like stored in the memory 41. Incidentally, to the interface 43, each part composing the image forming apparatus 1 is connected and various control signals are transmitted and received between the controlling device 8 and each part, although illustrating them in the figures is omitted.

Now, with reference to FIGS. 1 and 2, the operation of the image forming apparatus 1 will be described. When the power is supplied to the image forming apparatus 1, the image forming apparatus 1 carries out initialization of various parameters and others. Subsequently, when, from a computer or the like connected with the image forming apparatus 1, image data is inputted and a printing start is directed to the image forming apparatus 1, the image forming apparatus 1 (the controlling device 8) carries out image forming process as follows.

The charging roller 12 electrically charges the surface (the photosensitive layer 21) of the photosensitive drum 11. After that, the exposure device 13 carries out exposure (refer to an arrow P) corresponding to the image data on the surface of the photosensitive drum 11 to form the electrostatic latent image. This electrostatic latent image is developed to the toner image by the developing roller 14. The toner image is transferred onto the sheet conveyed from the sheet storing part 3 in the conveying path 4 by the transferring roller 15 to which the transferring bias (a negative polarity) is applied. The toner image is fixed onto the sheet S by the fixing device 6. The sheet S having the fixed toner image is ejected to the sheet ejecting part 7 by a pair of ejecting rollers 7*a*. The toner remained on the photosensitive layer 21 of the photosensitive drum 11 after the transferring is removed by the cleaning device 17 and the charge remained on the photosensitive layer 21 is eliminated by the static eliminating device 18.

Figure 4:
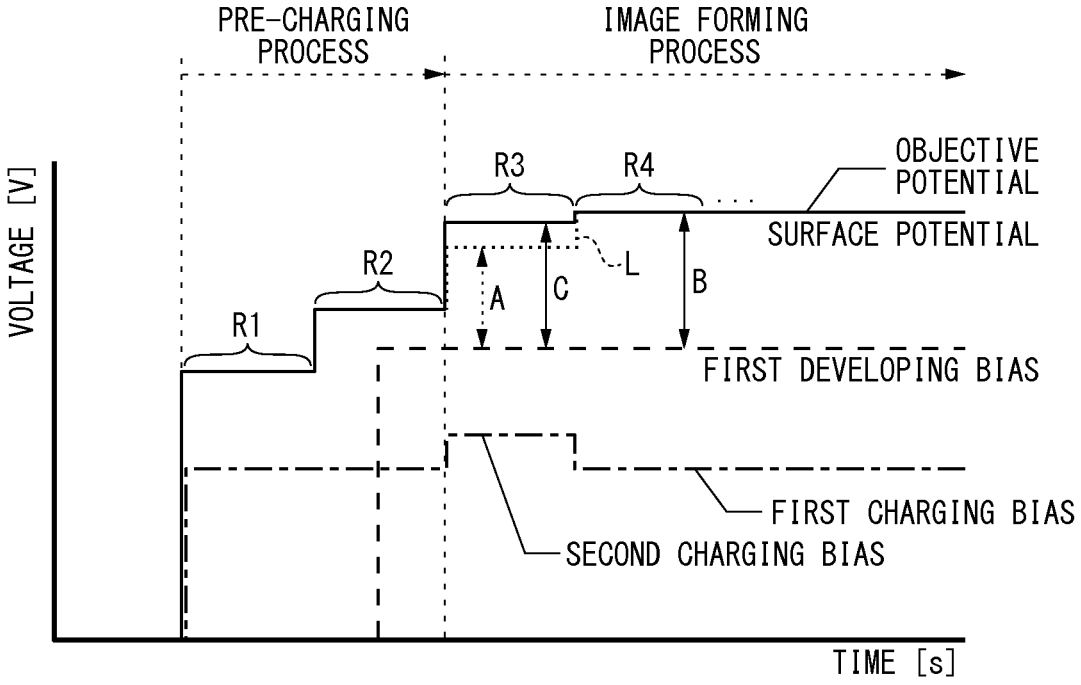
FIG. 4 is a graph, on which an electrical potential applied to each component and a time are plotted, with respect to control of the image forming part by the controlling device in the image forming apparatus in accordance with the first embodiment of the present disclosure.

Next, with reference to FIG. 4, the control of the image forming part 5 by the controlling device 8 will be described. Herein, FIG. 4 is an explanatory drawing illustrating a relationship between an electrical potential applied to each component and a time in the control of the image forming part 5 by the controlling device 8. Incidentally, a value of the electrical potential indicated in FIG. 4 is not necessarily precise, but correctly indicates the polarity and schematic variation of the electrical potential.

In general, in the charging roller 12 in the contact charging manner, because the surface potential of the photosensitive layer 21 of the photosensitive drum 11 made of the OPC is hardly increased, the charging bias is applied before the start of the image forming process. The process charging the photosensitive drum 11 before the start of the image forming process will be called as a "pre-charging process". For example, as shown in FIG. 4, in a case where the photosensitive drum 11 is rotated twice (R1, R2) as the pre-charging process, the surface potential of the photosensitive drum 11 is increased gradually for each rotation. In this example, the image forming process is started after the photosensitive drum 11 is rotated twice.

The application of the developing bias to the developing roller 14 is generally started before the start of the image forming process (during the pre-charging process), in order to make provision for the start of the image forming process in consideration of arise time. For example, as shown in FIG. 4, after the pre-charging process is started and the photosensitive drum 11 is rotated approximately once and half (at a timing traced back by half rotation from the start of the image forming process), the application of the developing bias is started.

When the pre-charging process applying the charging bias to the charging roller 12 is completed (the image forming process is started), the surface potential of the photosensitive drum 11 has been increased to an electrical potential indicated by a dotted line L in FIG. 4. In this time, although the surface potential of the photosensitive drum 11 has not been increased to the objective potential, the surface potential is an electrical potential enabling the image forming process. However, in a case where the surface potential of the photosensitive drum 11 is greatly separated from the objective potential, an electrical potential difference A between the surface potential of the photosensitive drum 11 and developing bias at that time is significantly smaller than a rated electrical potential difference B as an electrical potential difference determined a rated value for each apparatus. Then, in the image forming process, the toner may be moved from the developing roller 14 to a side of the photosensitive drum 11, and then, a phenomenon making the toner adhere to a white area, on which the image is not formed, in the sheet S, (hereinafter, called as "fogging") may occur.

Now, the controlling device 8 of the image forming apparatus 1 according to the first embodiment of the present disclosure carries out pre-charging control and post-charging control in order to prevent image failure according to the fogging. Concretely, the controlling device 8 carries out the pre-charging control controlling the charging bias power source 24 to electrically charge the surface of the photosensitive drum 11 before starting the image forming process. Moreover, the controlling device 8 carries out the post-charging control controlling the charging bias power source 24 and developing bias power source 25 to adjust the electrical potential difference between the surface potential of the photosensitive drum 11 and developing bias to a significant electrical potential difference C preventing the occurrence of the image failure. In the following, each control carried out by the controlling device 8 will be described in detail.

For example, when the power is supplied to the image forming apparatus 1 and a print request is issued to the image forming apparatus 1, the image forming apparatus 1 (the controlling device 8) carries out the pre-charging process in advance of the image forming process. The controlling device 8 carries out the pre-charging control in order to start the pre-charging process. The controlling device 8 controls the driving device to rotate the photosensitive drum 11, charging roller 12, developing roller 14, transferring roller 15 and others. Moreover, the controlling device 8 controls the charging bias power source 24 as the pre-charging control to output a first charging bias (for example, a degree of 1200V) as a rated charging bias. Thereby, the pre-charging process is started, and then, as indicated by a solid line in FIG. 4, the surface potential of the photosensitive drum 11 is increased gradually for each rotation. In addition, the controlling device 8 controls the developing bias power source 25 to output a first developing bias as a rated developing bias after the photosensitive drum 11 is rotated approximately once and half.

When the photosensitive drum 11 is rotated twice (R1, R2), the pre-charging process (the pre-charging control) is completed and the controlling device 8 starts the image forming process already described. The controlling device 8 controls the developing bias power source 25 to apply continuously the first developing bias and controls the charging bias power source 24 to apply a second charging bias higher than the first charging bias as the post-charging control.

By applying the second charging bias instead of the first charging bias, the surface potential of the photosensitive drum 11 becomes the objective potential or an approximate objective potential. Thereby, for example, if an insufficiently of the charge of the photosensitive drum 11 in the pre-charging process is caused, it is possible to bring the surface potential of the photosensitive drum 11 close to the rated value (the objective potential). In the start (R3) of the image forming, the electrical potential difference between the surface potential of the photosensitive drum 11 and first developing bias is the significant electrical potential difference C. The significant electrical potential difference C is a slightly lower value than the rated electrical potential difference B.

For example, if the objective potential of the photosensitive drum 11, first developing bias and rated electrical potential difference B are respectively set to 410V, 290V and 120V, the surface potential of the photosensitive drum 11 is preferably kept within 350V or more to 450V or less (within a degree of the objective potential plus or minus 40V). The significant electrical potential difference C is preferably kept, for example, within 60V or more. The significant electrical potential difference C is set to a range where the image failure according to the fogging is not occurred, for example, set on the basis of experiments or experiences.

Incidentally, the respective values of the first charging bias, second charging bias and first developing bias, and the rated electrical potential difference B and significant electrical potential difference C are stored in the memory 41 in advance. The charging bias implies the first charging bias and second charging bias and indicates all biases applied to the charging roller 12. Similarly, the developing bias implies the first developing bias and indicates all biases applied to the developing roller 14.

The controlling device 8 carries out the post-charging control applying the second charging bias during a period from the start of the image forming process until the photosensitive drum 11 is rotated once (R3 (the third time in total)). The controlling device 8 controls the charging bias power source 24 to output the first charging bias instead of the second charging bias after the image forming process is started and the photosensitive drum 11 is rotated once (R4). Incidentally, in this time, the photosensitive drum 11 is in a state of being charged to the objective potential.

In accordance with the image forming apparatus 1 according to the first embodiment mentioned above, by the post-charging control carried out by the controlling device 8, the electrical potential difference between the surface potential of the photosensitive drum 11 and (first)) developing bias is controlled so as to be kept to the significant electrical potential difference C. Since the significant electrical potential difference C is set to the range where the image failure according to the fogging is not occurred, it is possible to secure excellent image forming.

Moreover, in accordance with the image forming apparatus 1 according to the first embodiment, for example, if the insufficiently of the charge of the photosensitive drum 11 in the pre-charging control (process) is caused, it is possible to bring the significant electrical potential difference C close to the rated electrical potential difference B during the period from the start of the image forming process until the photosensitive drum 11 is rotated once (makes one round). Thereby, it is possible to carry out appropriate image forming to a first sheet S without the fogging.

Further, in accordance with the image forming apparatus 1 according to the first embodiment, by applying the positive charged monolayer organic photoconductor as the surface of the photosensitive drum 11, i.e., the photosensitive layer 21, it is possible to restrain occurrence of ozone in the charging process and to form the image in high resolution. In addition, due to the monolayer structure, it is possible to design simplification of production process.

The number of the rotation of the photosensitive drum 11 in the pre-charging control (process) is not restricted to two rotations, but it may be optionally set to one rotation or more in consideration of a first print time. Although, in the image forming apparatus 1 according to the first embodiment mentioned above, the controlling device 8 carries out the post-charging control during the period from the start of the image forming process until the photosensitive drum 11 is rotated once (makes one round), the present disclosure is not restricted by this. For example, the post-charging control may be carried out over two rotations or more.

Figure 5:
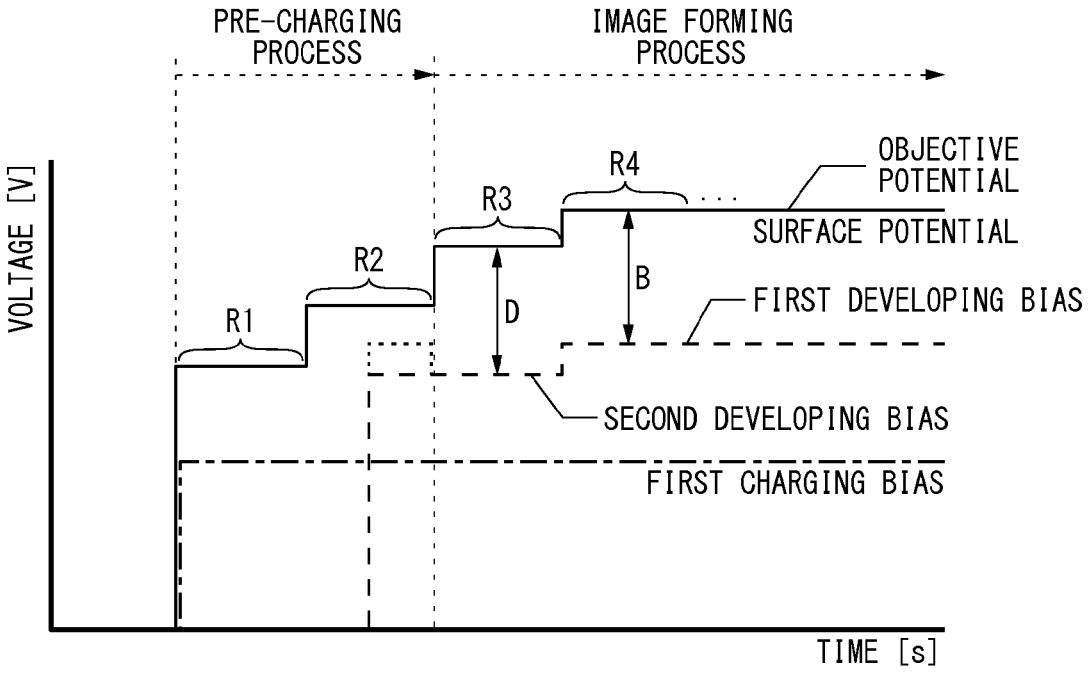
FIG. 5 is a graph, on which an electrical potential applied to each component and a time are plotted, with respect to control of the image forming part by the controlling device in the image forming apparatus in accordance with a second embodiment of the present disclosure.

Next, with reference to FIG. 5, the image forming apparatus 1 according to a second embodiment will be described. FIG. 5 is an explanatory drawing illustrating a relationship between an electrical potential applied to each component and a time in the control of the image forming part 5 by the controlling device 8. Incidentally, a value of the electrical potential indicated in FIG. 5 is not necessarily precise, but correctly indicates the polarity and schematic variation of the electrical potential. It is noted that the same or corresponding components with those of the first embodiment mentioned above will be denoted by the same reference numerals and their explanation will be omitted.

For example, when the power is supplied to the image forming apparatus 1 and a print request is issued to the image forming apparatus 1, similarly to the above-mentioned first embodiment, the controlling device 8 controls the charging bias power source 24 to output the first charging bias as the pre-charging control. Subsequently, the controlling device 8 controls the developing bias power source 25 to output a second developing bias lower than the first developing bias after the photosensitive drum 11 is rotated approximately once and half. Incidentally, the second developing bias is stored in the memory 41 in advance. The developing bias implies the first developing bias and second developing bias and indicates all biases applied to the developing roller 14.

When the photosensitive drum 11 is rotated twice (R1, R2), the pre-charging control (process) is completed and the controlling device 8 starts the image forming process already described. The controlling device 8 carries out the post-charging control according to the second embodiment together with the start of the image forming process. The controlling device 8 controls the charging bias power source 24 so as to apply continuously the first charging bias and controls the developing bias power source 25 so as to apply continuously the second developing bias as the post-charging control. The controlling device 8 carries out the post-charging control applying the second developing bias during the period from the start of the image forming process until the photosensitive drum 11 is rotated once (R3). The controlling device 8 controls the developing bias power source 25 so as to output the first developing bias instead of the second developing bias after the image forming process is started and the photosensitive drum 11 is rotated once (R4).

During the period from the start of the image forming process until the photosensitive drum 11 is rotated once (R3), the surface potential of the photosensitive drum 11 is the electrical potential enabling the image forming process, but is a value lower than the objective potential. In such a state, if the first developing bias were applied to the developing roller 14, because the electrical potential difference A (refer to FIG. 4) would be significantly smaller than the rated electrical potential difference B, the fogging would be caused. By contrast, in the image forming apparatus 1 according to the second embodiment, since the second developing bias lower than the first developing bias is applied to the developing roller 14, the significant electrical potential difference D between the surface potential of the photosensitive drum 11 and second developing bias in the start of the image forming (R3) is kept in approximately the same value (correctly, a slightly lower value) as the rated electrical potential difference B (for example, 120V).

In accordance with the image forming apparatus 1 according to the second embodiment mentioned above, since the second developing bias lower than the first developing bias is applied to the developing roller 14, for example, if the insufficiently of the charge of the photosensitive drum 11 in the pre-charging control (process) is caused, it is possible to kept the electrical potential difference between the surface potential of the photosensitive drum 11 and second developing bias to the significant electrical potential difference D. Thereby, it is possible to effectively prevent the image failure (the fogging).

Although, in the image forming apparatus 1 according to the second embodiment mentioned above, the controlling device 8 controls the developing bias power source 25 so as to output (apply) the second developing bias before the start of the image forming process, the present disclosure is not restricted by this. For example, the controlling device 8 may control the developing bias power source 25 to output the first developing bias when the photosensitive drum 11 is rotated approximately once and half, and then, to output the second developing bias when the photosensitive drum 11 is further rotated approximately half and the image forming process is started (refer to a dotted line portion of the developing bias indicated in FIG. 5). That is, the second developing bias has to be applied at least in charge control after the image forming process is started.

Incidentally, similarly to the first embodiment mentioned above, the rotation of the photosensitive drum 11 in the pre-charging control (process) may be optionally set to one rotation or more. Moreover, the post-charging control according to the second embodiment may be carried out over two rotations or more.

Figure 6:
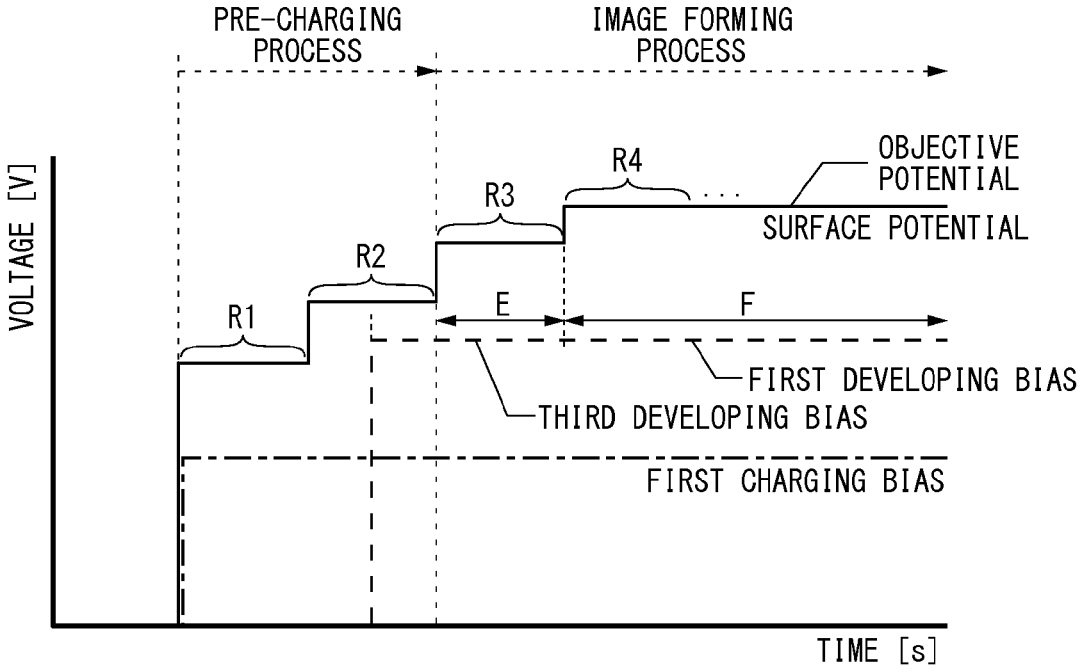
FIG. 6 is a graph, on which an electrical potential applied to each component and a time are plotted, with respect to control of the image forming part by the controlling device in the image forming apparatus in accordance with a third embodiment of the present disclosure.

Next, with reference to FIG. 6, the image forming apparatus 1 according to a third embodiment will be described. FIG. 6 is an explanatory drawing illustrating a relationship between an electrical potential applied to each component and a time in the control of the image forming part 5 by the controlling device 8. Incidentally, a value of the electrical potential indicated in FIG. 6 is not necessarily precise, but correctly indicates the polarity and schematic variation of the electrical potential. It is noted that the same or corresponding components with those of the first embodiment mentioned above will be denoted by the same reference numerals and their explanation will be omitted.

For example, when the power is supplied to the image forming apparatus 1 and a print request is issued to the image forming apparatus 1, similarly to the above-mentioned first embodiment, the controlling device 8 controls the charging bias power source 24 to output the first charging bias as the pre-charging control. Subsequently, the controlling device 8 controls the developing bias power source 25 to output a third developing bias having a higher frequency than a frequency of alternating current voltage of the first developing bias after the photosensitive drum 11 is rotated approximately once and half. Incidentally, the frequency of the alternating current voltage of the first developing bias is, for example, 2600 Hz and the frequency of alternating current voltage of the third developing bias is, for example, 2800 Hz. The third developing bias is stored in the memory 41 in advance. The developing bias implies the first developing bias and third developing bias and indicates all biases applied to the developing roller 14.

When the photosensitive drum 11 is rotated twice (R1, R2), the pre-charging control (process) is completed and the controlling device 8 starts the image forming process already described. The controlling device 8 carries out the post-charging control according to the third embodiment together with the start of the image forming process. The controlling device 8 controls the charging bias power source 24 so as to apply continuously the first charging bias and controls the developing bias power source 25 so as to apply continuously the third developing bias as the post-charging control. The controlling device 8 carries out the post-charging control applying the third developing bias (refer to an arrow E in FIG. 6) during the period from the start of the image forming process until the photosensitive drum 11 is rotated once (R3). The controlling device 8 controls the developing bias power source 25 so as to output the first developing bias instead of the third developing bias (refer to an arrow F in FIG. 6) after the image forming process is started and the photosensitive drum 11 is rotated once.

In accordance with the image forming apparatus 1 according to the third embodiment mentioned above, since the third developing bias having the higher frequency than the first developing bias is applied to the developing roller 14. By thus heightening the frequency of the alternating current voltage, advance movement of the toner from the developing roller 14 to the photosensitive drum 11 and back movement of the toner from the photosensitive drum 11 to the developing roller 14 are mutually switched at a short interval. Therefore, the toner is brought back to a side of the developing roller 14 before movement of the toner to the side of the photosensitive drum 11 is advanced. Thereby, it is possible to effectively prevent the image failure (the fogging).

Although, in the image forming apparatus 1 according to the third embodiment mentioned above, the controlling device 8 controls the developing bias power source 25 so as to output (apply) the third developing bias before the start of the image forming process, the present disclosure is not restricted by this. For example, the controlling device 8 may control the developing bias power source 25 to output the first developing bias when the photosensitive drum 11 is rotated approximately once and half, and then, to output the third developing bias when the photosensitive drum 11 is further rotated approximately half and the image forming process is started. That is, the third developing bias has to be applied at least in charge control after the image forming process is started.

Incidentally, similarly to the first embodiment, the rotation of the photosensitive drum 11 in the pre-charging control (process) may be optionally set to one rotation or more. Moreover, the post-charging control according to the third embodiment may be carried out over two rotations or more.

Although, in the image forming apparatus 1 according to each embodiment, the charging roller 12 rotatably comes into contact with the surface (the photosensitive layer 21) of the photosensitive drum 11, the charging roller 12 does not need to come into contact with the photosensitive drum 11 necessarily. That is, if an electric discharge possible area is secured between the charging roller 12 and photosensitive drum 11, the charging roller 12 and photosensitive drum 11 may be arranged in a non-contact state (a close contact state). Herein, the close contact state implies a state where the surface (the outer circumference face of the photosensitive layer 21) of the photosensitive drum 11 and the surface (the outer circumference face of the charging rubber layer 23) of the charging roller 12 are separated from each other, for example, at a distance of a degree of 5-100 μm.

Although, in the above-mentioned embodiment, the monochrome image forming apparatus 1 was described, the present disclosure is not restricted by this, but may be applied to a color printer. In such a case, it is preferable to arrange an intermediate transfer belt, a second transferring part and others.

While the preferable embodiment and its modified example of the image forming apparatus of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

What is claimed is:

1. An image forming apparatus comprising:

a charging member arranged to come into contact with a surface of an image carrier so as to electrically charge the surface of the image carrier;

a charging bias power source applying a charging bias as a direct current voltage to the charging member;

a developing member arranged to face to the surface of the image carrier so as to develop a toner image onto the surface of the image carrier;

a developing bias power source applying a developing bias taken by superposing alternating current voltage and direct current voltage to the developing member; and a controlling device controlling the charging bias power source and developing bias power source, wherein the controlling device carries out pre-charging control, before starting image forming process transferring the toner image developed on the surface of the image carrier to a transferred medium, to control the charging bias power source so as to electrically charge the surface of the image carrier, and carries out post-charging control, after the image forming process is started, to control the charging bias power source and developing bias power source so as to adjust an electrical potential difference between a surface potential of the image carrier and developing bias to an electrical potential that forms an image difference preventing occurrence of image failure, and wherein the controlling device controls the developing bias power source so as to apply a first developing bias as a rated developing bias and controls the charging bias power source so as to apply a second charging bias higher than a first charging bias as a rated charging bias as the post-charging control.

2. The image forming apparatus according to claim 1, further comprising:

the controlling device storing the electrical potential that forms an image difference set to 60V or more.

3. The image forming apparatus according to claim 1, wherein the image carrier is arranged rotatably, the controlling device carries out the post-charging control during a period from the start of the image forming process until the image carrier is rotated once.

4. The image forming apparatus according to claim 1, wherein the surface of the image carrier is made of a positive charged monolayer organic photoconductor.

5. An image forming apparatus comprising:

a charging member arranged to come into contact with a surface of an image carrier so as to electrically charge the surface of the image carrier;

a charging bias power source applying a charging bias as a direct current voltage to the charging member;

a developing member arranged to face to the surface of the image carrier so as to develop a toner image onto the surface of the image carrier;

a developing bias power source applying a developing bias taken by superposing alternating current voltage and direct current voltage to the developing member; and a controlling device controlling the charging bias power source and developing bias power source, wherein the controlling device carries out pre-charging control, before starting image forming process transferring the toner image developed on the surface of the image carrier to a transferred medium, to control the charging bias power source so as to electrically charge the surface of the image carrier, and carries out post-charging control, after the image forming process is started, to control the charging bias power source and developing bias power source so as to adjust an electrical potential difference between a surface potential of the image carrier and developing bias to an electrical potential that forms an image difference preventing occurrence of image failure, and wherein the controlling device controls the charging bias as a rated charging bias and controls the developing bias power source so as to apply a second developing bias power source so as to apply a second developing bias lower than a first developing bias as a rated developing bias as the post-charging control.

6. The image forming apparatus according to claim 5, wherein the controlling device controls the developing bias power source so as to apply the second developing bias before the start of the image forming process.

7. An image forming apparatus comprising:

a charging member arranged to come into contact with a surface of an image carrier so as to electrically charge the surface of the image carrier;

a charging bias power source applying a charging bias as a direct current voltage to the charging member;

a developing member arranged to face to the surface of the image carrier so as to develop a toner image onto the surface of the image carrier;

a developing bias power source applying a developing bias taken by superposing alternating current voltage and direct current voltage to the developing member; and a controlling device controlling the charging bias power source and developing bias power source, wherein the controlling device carries out pre-charging control, before starting image forming process transferring the toner image developed on the surface of the image carrier to a transferred medium, to control the charging bias power source so as to electrically charge the surface of the image carrier, and carries out post-charging control, after the image forming process is started, to control the charging bias power source so as to apply a first charging bias as a rated charging bias and to control the developing bias power source so as to apply a third developing bias having a higher frequency than a frequency of alternating current voltage of a first developing bias as a rated developing bias.

8. The image forming apparatus according to claim 7, wherein the control device controls the developing bias power source so as to apply the third developing bias before the start of the image forming process.

9. The image forming apparatus according to claim 7, wherein the image carrier is arranged rotatably, the controlling device carries out the post-charging control during a period from the start of the image forming process until the image carrier is rotated once.

10. The image forming apparatus according to claim 7, wherein the surface of the image carrier is made of a positive charged monolayer organic photoconductor.

* * * * *